United States Patent [19]

Martin et al.

[11] 3,938,350

[45] Feb. 17, 1976

[54] FREEZE TUNNEL

[75] Inventors: Patrick S. Martin; Barron M. Moody, both of Dallas, Tex.

[73] Assignee: Cryogenics Corporation of America, Dallas, Tex.

[22] Filed: Dec. 10, 1973

[21] Appl. No.: 423,333

Related U.S. Application Data

[63] Continuation-in-part of Ser. No. 250,616, May 5, 1972, Pat. No. 3,802,212.

[52] U.S. Cl. ..... 62/156; 62/203; 62/208; 62/380

[51] Int. Cl.[2] ..... F25D 21/06

[58] Field of Search ..... 62/80, 151, 154, 156, 514, 62/380, 63, 216, 208, 203

[56] References Cited

UNITED STATES PATENTS

| | | | |
|---|---|---|---|
| 3,263,441 | 8/1966 | Rother | 62/380 X |
| 3,374,640 | 3/1968 | Boese | 62/514 X |
| 3,757,531 | 9/1973 | Gement, Jr. | 62/156 |

*Primary Examiner*—William F. O'Dea
*Assistant Examiner*—Ronald C. Capossela
*Attorney, Agent, or Firm*—Howard E. Moore; Gerald G. Crutsinger

[57] ABSTRACT

Freezing apparatus in which food is quickly frozen comprising five coils, two joined in series to form a first set and two joined in series to form a second set, the exhaust of the two sets being delivered to the fifth coil in a pre-cooling chamber where food is introduced by a conveyor to the freeze tunnel. Each of the five coils is positioned in a separate chamber in the tunnel and thermal couple sensors deliver signals which are compared to a set-point signal in proportional controllers to control the flow of liquid nitrogen to each set of coils. Flow from the first and second sets of coils is vented to atmosphere and heater apparatus adjacent the fifth coil is energized when the temperature of nitrogen vapor discharged from the fifth coil is less than a predetermined value which results when formation of ice on the surface of the fifth coil reduces exchange of the heat between air circulated over the fifth coil and nitrogen vapor flowing therethrough.

11 Claims, 8 Drawing Figures

FREEZE TUNNEL

CROSS-REFERENCES TO RELATED APPLICATIONS

This is a continuation-in-part of our co-pending application, Ser. No. 250,616 filed May 5, 1972 entitled "Refrigeration Apparatus" now U.S. Pat. No. 3,802,212.

BACKGROUND

Heretofore mechanical refrigeration units and spray systems have been employed for cooling or freezing food products.

Mechanical refrigeration systems generally employ Freon 22 or ammonia as a refrigerant and employ brine or air as intermediate coolant.

Spray systems generally spray vapor of cryogenic liquid, such as nitrogen or carbon dioxide, through nozzles into a compartment through which food is conveyed. Spray systems have ceratin advantages over mechanical refrigeration units heretofore devised because of faster freezing and consequently less shrinkage, simplicity of operation, ease of maintenance and relatively low initial installation cost. However, a primary disadvantage of spray systems as compared to mechanical refrigeration units involves higher operating cost because the cooling capacity of the vapor has not been efficiently utilized. Further, meats exposed to a nitrogen enriched atmosphere often absorb the nitrogen resulting in discoloration of the meat.

SUMMARY OF INVENTION

We have devised an improved method and apparatus for freezing food products which incorporates certain advantages of both mechanical and spray type refrigeration units while eliminating many of the inherent disadvantages of each type of system.

The cooling apparatus comprises circular coils connected through proportionally controlled valves to a source of liquid nitrogen to provide controlled evaporation of the liquid nitrogen to permit full utilization of the sensible heat of nitrogen vapor. The cooling coils are positioned around a centrifugal blower such that air is circulated over food products carried by a conveyor and in heat exchange relation with the cooling coils providing rapid exchange of heat to quickly freeze water in the food forming small crystals.

A preferred form of the invention comprises five cooling coils, two of which are joined in series to form one set.

The exhaust of the two sets is connected to the inlet of the fifth coil in a pre-cooling chamber adjacent the entrance end of the cooling apparatus. Control valves are mounted between an exhaust line from the first and second sets of coils and the inlet of the fifth coil, the valve being actuatable to permit flow of coolant through the fifth coil or to exhaust the coolant prior to reaching the fifth coil to facilitate defrosting the fifth coil which is positioned at the entrance to the freezer apparatus.

Temperature sensors are positioned such that control apparatus will stop the motor driving the centrifugal fan associated with the fifth coil, will block flow of coolant through the fifth coil, and energize heater apparatus to defrost the fifth coil when the temperature difference between nitrogen exhausted from the fifth coil and the temperature of air being circulated across the fifth coil exceeds a predetermined value.

A primary object of the invention is to provide freezer apparatus which efficiently employs vapor of a liquified cryogenic gas to cool coils over which air is circulated for cooling food products to provide fast freezing at a low operating cost.

Another object of the invention is to provide freezer apparatus having a plurality of freezing chambers monitored by temperature sensors arranged to control the introduction of vapor of a cryogenic gas to provide controlled evaporation and full utilization of sensible heat.

Another object of the invention is to provide freezer apparatus having a plurality of sets of cooling coils, the coils of each set being connected in series while the sets are connected in parallel to provide heat transfer from air circulated over coils such that the temperature of the circulated air approximates the temperature of vapor exhausted from the system.

Another object of the invention is to provide freezer apparatus having a cryogenic evaporator coil adapted to be triggered to a defrost cycle when the temperature differential between vapor exhausted from the evaporator coil and return air drawn across surfaces of the evaporator coil exceeds a predetermined limit.

A further object is to provide freezer apparatus comprising a plurality of heat exchangers which can be defrosted individually without interruption of operation of the freezer apparatus.

A still further object of the invention is to provide a refrigeration apparatus having a minimum number of moving parts to provide a reliable system requiring minimum maintenance.

Other and further objects of the invention will become apparent upon referring to the detailed description hereinafter following and to the drawings annexed hereto.

DESCRIPTION OF DRAWING

Drawings of a preferred embodiment of the invention are annexed hereto so that the invention may be better and more fully understood, in which.

Numeral references are employed to designate like parts throughout the various figures of the drawing.

PREFERRED EMBODIMENT

Figure 1:
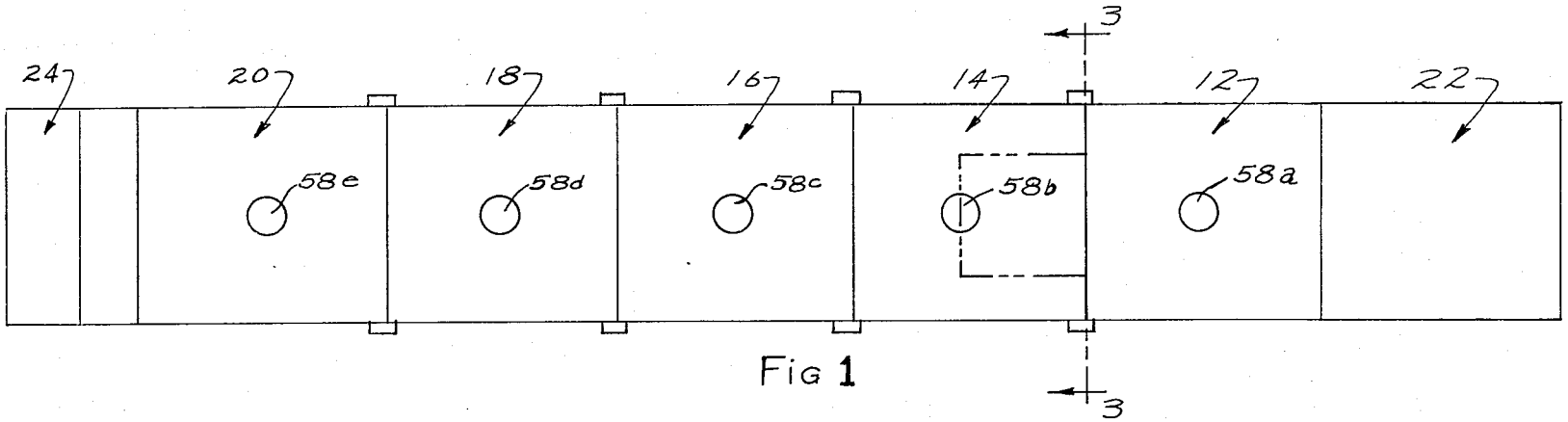
FIG. 1 is a plan view of the freeze tunnel.
Figure 2:
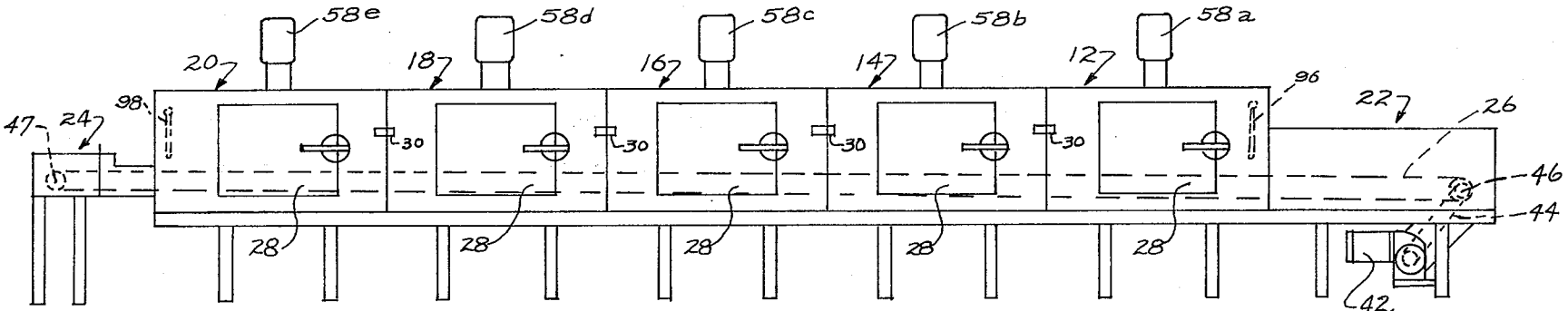
FIG. 2 is a side elevational view.

Referring to FIGS. 1 and 2 of the drawing the numeral 10 generally designates a freeze tunnel comprising a cooling compartment divided into a first pre-cooling zone 12, a second pre-cooling zone 14, a sub-freezing zone 16, a freezing zone 18, and an equilibrium zone 20.

Loading and discharge zones 22 and 24 are disposed adjacent opposite ends of freeze tunnel 10 and suitable conveyor means 26 is employed for moving articles from the entrance or loading zone 22 through the zones 12–20 to the discharge end 24 of freezer apparatus 10.

Zones 12–20 preferably comprise modular construction units M of substantially identical construction having entry doors 28 adjacent at least one side thereof and having connector openings adjacent opposite ends thereof through which conveyor 26 is moveable. The units M are secured together by suitable disengageable connectors 30 to form an elongated compartment.

Suitable means is provided for circulating air in zones 12 20 over products carried by conveyor 26 for freezing as will be hereinafter described.

While the temperatures in each zone may vary under specified operating conditions, zone 12 is preferably maintained at for example −20°F, zone 14 at −50°F, zone 16 at −100°F zone 18 at −200°F and zone 20 at −250°F. Controlling temperatures in zones 12–20 thusly provides freezing of a hamburger patty, introduced at an initial temperature of 50°F, to a discharge temperature of 0°F in approximately 6 minutes.

Each of the modular units M preferably has side walls 32 and 34, a top 36 and bottom 38 comprising spaced sheets 38*a* and 38*b* of stainless steel material, the space therebetween being filled by a sheet 38*c* of suitable insulator material, such as high density Styrofoam or foamed polyurethane.

Each of the modules has connector means 30 at opposite ends thereof for connecting the units together to form an elongated chamber or tunnel. However, the modular elements may be disconnected to facilitate cleaning, maintenance and periodic inspections.

Figure 3:
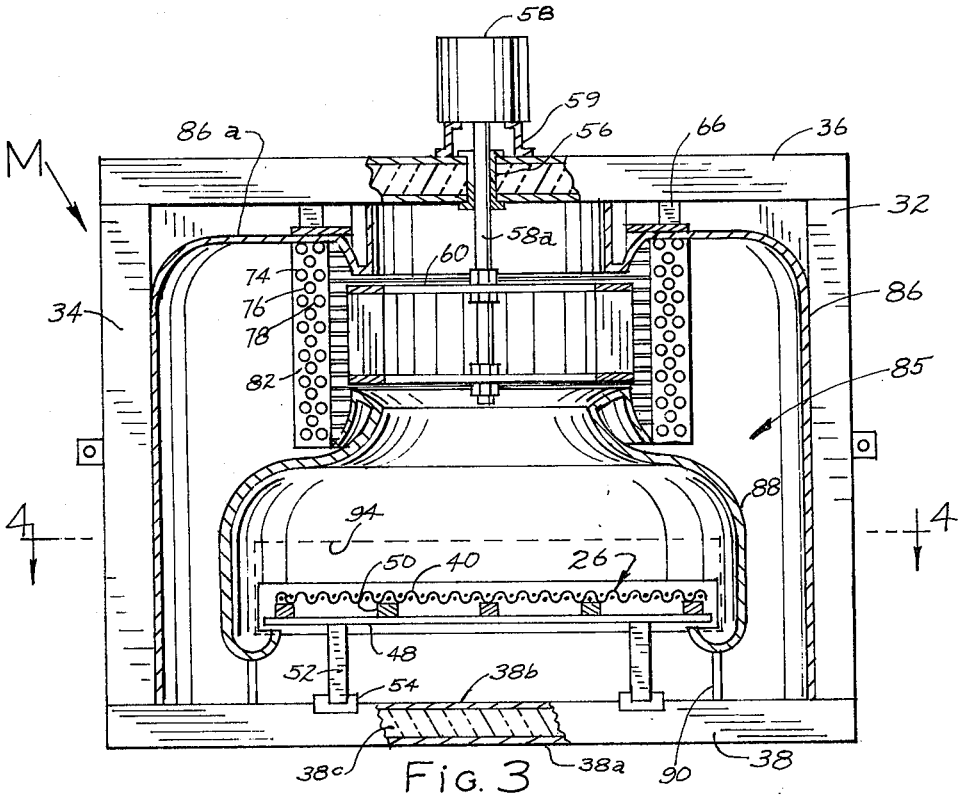
FIG. 3 is a cross-sectional view taken along line 3—3 of FIG. 1.

As best illustrated in FIGS. 2 and 3, the conveyor 26 comprises an endless flexible belt, preferably constructed of stainless steel equalized mesh and is driven by a infinitely adjustable variable speed motor 42 through a chain 44 extending about driven sprocket 46 rotatably mounted in the loading zone 22 of freeze tunnel 10. Belt 40 extends about a sprocket 48 rotatably secured in the discharge zone 24 of freeze tunnel 10. Sprocket 48 is preferably adjustable to control tension of belt 40.

Suitable conveyor support apparatus extends longitudinally of each of the modular units of zones 12–20 to prevent sagging of conveyor belt 40. In the particular embodiment of the invention illustrated in the drawing, the conveyor support comprises spaced transversly extending support bars 48 having spaced wear bars 50 secured to the upper side thereof and extending longitudinally through the chamber in the modular elements. Support bars 48 are secured to upper ends of stanchions 52 having lower ends welded or otherwise secured to base elements 54 to distribute loading over a substantial area of the surface of the inner sheet 38*b* of the bottom 38.

Belt 40, having perforations extending therethrough, slides along the upper surface of wear bars 50 upon rotation of drive sprocket 46.

As best illustrated in FIG. 3 of the drawing, the top 36 has a central opening in which bearing 56 is mounted. Motor 58 is secured to top 36 by motor mounts 59 and has a shaft 58*a* to which a centrifugal type fan 60 is mounted.

A heat exchanger element 62 has an upper end secured to a mounting plate 64 suspended from the top 36 of the modular element by support elements 66.

Figure 5:
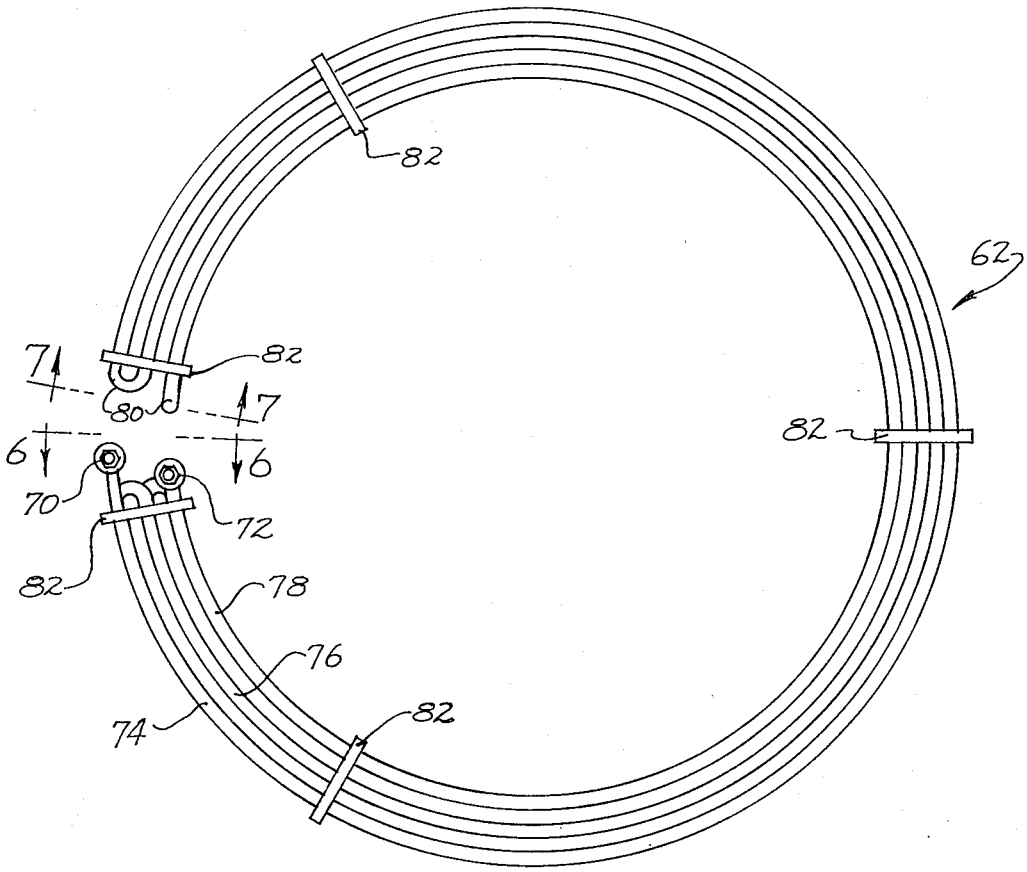
FIG. 5 is a plan view of a cooling coil.
Figure 6:
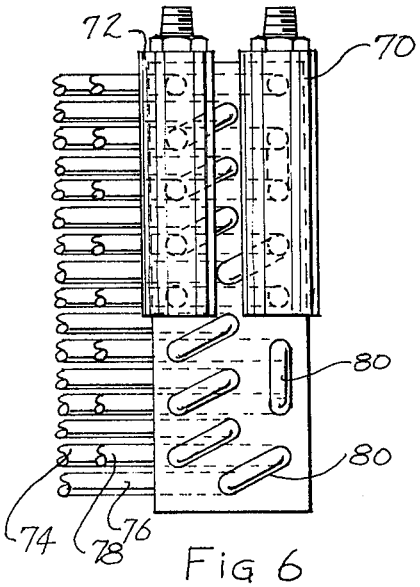
FIG. 6 is a cross-sectional view taken along line 6—6 of FIG. 5.
Figure 7:
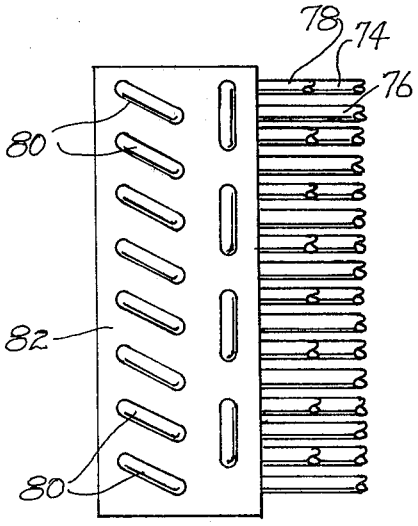
FIG. 7 is a cross-sectional view taken along line 7—7 of FIG. 5.

Heat exchanger 62 is best illustrated in FIGS. 5, 6, and 7 and comprises a circular coil having intake and discharge manifolds 70 and 72 respectively joined by outer tubes 74 intermediate tubes 76 and inner tube 78. Suitable connector tubes 80 join ends of tubes 74, 76, and 78 such that fluid entering intake manifold 70 passes through a plurality of tubes in route to the exhaust manifold 72.

Tubes 74, 76 and 78 are preferably constructed of copper or other suitable heat conductive material and extend through spacer plates 82 having perforations formed therein to maintain horizontal and vertical spacing to permit flow of air over surfaces of the tubes.

Figure 4:
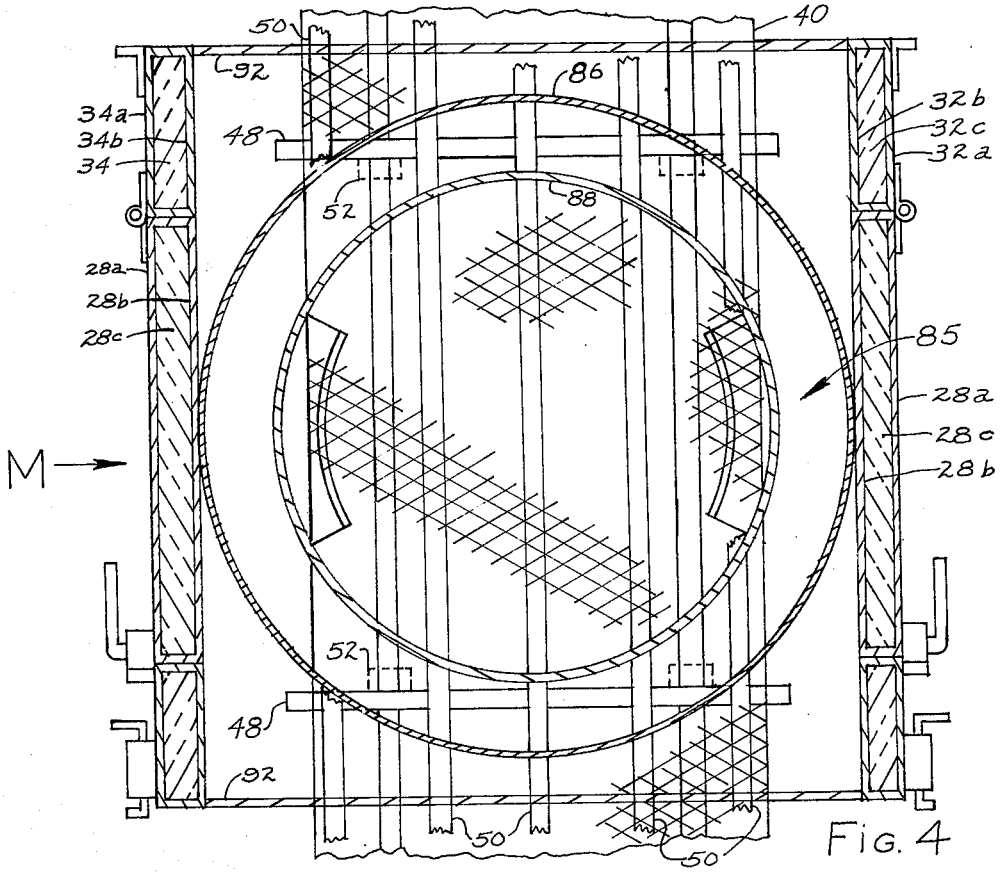
FIG. 4 is a cross-sectional view taken along line 4—4 of FIG. 3.

As best illustrated in FIGS. 3 and 4 of the drawing an annular plenum 85 is formed about heat exchanger 62 and comprises an outer cylindrical shroud 86 having an inwardly deflected upper end 86*a*. The inner wall of the plenum 85 comprises a cylindrical member 88 having a reduced diameter area adjacent the upper end thereof forming a throat 88*a*. The upper end of cylindrical member 88 extends outwardly to a position adjacent the lower end of heat exchanger 62 and the lower end has a cutout portion 90 permitting downward flow of air from heat exchanger 62 through the annular passage between shroud 82 and cylindrical member 88 and then through the cut-out portion 90 and upwardly through perforations in conveyor belt 40 to the suction side of the centrifugal fan 60.

From the foregoing it should be readily apparent that the centrifugal fan 60 urges air outwardly across tubes 74, 76, and 78 of heat exchanger 62 and that the air is delivered upwardly through conveyor 40 to provide substantially uniform cooling of products carried by the conveyor 40.

Baffles 92 extend across opposite ends of each of the modular elements and have connector doors or passages 94 formed therein to permit passage of conveyor belt 40 and products carried thereon from one modular element to the other while preventing passage of substantial quantities of air from one modular element to the other. It should be readily apparent that since zones 12–20 are isolated one from the other temperature in each of the zones can be controlled to provide optimum conditions for sequentially reducing temperature as the product is carried through the various zones by conveyor 26.

To minimize entry of warm air and escape of cold air from pre-cooling zone 12 and equilibrium zone 20, curtains 96 and 98' constructed of Mylar or other suitable material are positioned across entrance openings to the zones.

Figure 8:
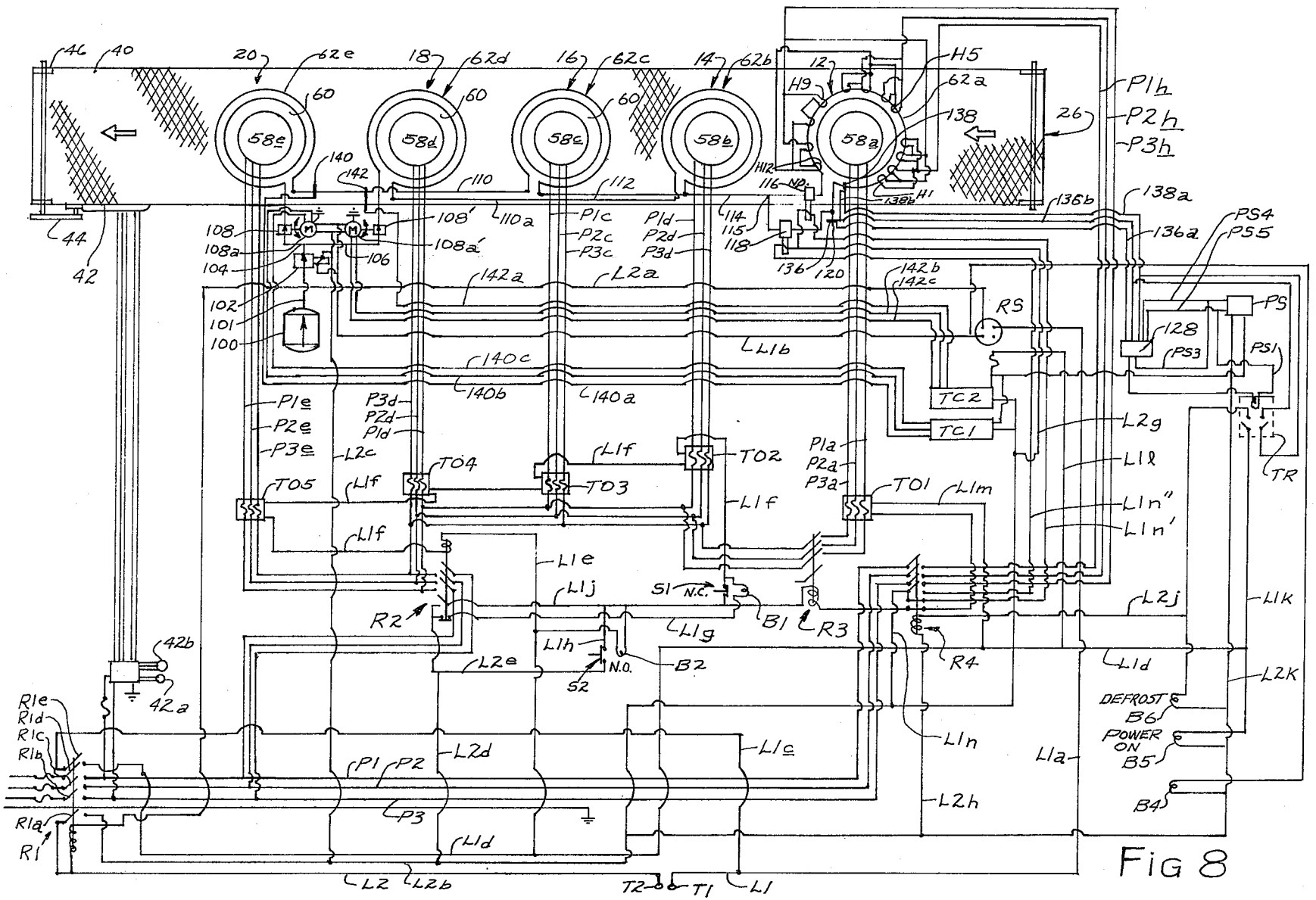
FIG. 8 is a diagrammatic view of the control apparatus.

As diagrammatically illustrated in FIG. 8 a container 100 of liquid nitrogen, carbon dioxide, or suitable liquified cryogenic gas is connected through supply line 101 to a solenoid actuated control valve 102 which has an outlet passage connected to feed lines 104 and 106.

Feed line 104 is connected through a motorized flow control valve 108 to the intake manifold 70 of the coil 62*e* of equilibrium zone 20. The exhaust manifold of the coil of zone 20 is connected through line 110 to the intake manifold of the coil 62*c* of sub-freezing zone 16 while the exhaust manifold of the coil in zone 16 is connected through line 112 to an exhaust line 114 connected through a tee 115 with solenoid actuated valves 116 and 118.

The outlet of valve 16 is connected to the intake manifold 70 of the coil 62*a* of zone 12 and the exhaust manifold 72 of coil 62*a* is connected to a vent line 120 through which vapor is discharged outside of freeze tunnel 10. The outlet of valve 118 is connected directly to vent line 120.

The feed line 106 is connected through motorized flow control valve 108a to the intake manifold 70 of the coil 62*d* in zone 18. The exhaust manifold 72 of coil 62*d* in zone 18 is connected through line 110*a* to the intake manifold 70 of coil 62*b* in zone 14. The exhaust manifold 72 of coil 62*b* in zone 14 is connected to exhaust line 114 which is hereinbefore described as connected through tee 115 to solenoid actuated valves 116 and 118.

From the foregoing it should be readily apparent that the coils in zones 16 and 20 are connected in series forming a first set of coils and the coils in zones 14 and 16 are connected in series forming a second set of coils. The first and second sets of coils are connected in parallel exhausting fluid to exhaust line 114. Under normal operating conditions solenoid actuated valve 116 is open and solenoid actuated valve 118 is closed such that fluid flowing from exhaust line 114 is delivered through the coil 62*a* in zone 12 to the vent line 120. However, as will be hereinafter more fully explained, when coil 62*a* becomes iced, requiring defrosting, valve 116 will be closed and valve 118 opened to deliver fluid from exhaust line 114 directly to vent line 120 thereby by-passing the coil 62*a* in zone 12.

The tubes in heat exchanger coil 62*a* in zone 12 and coil 62*b* in zone 14 preferably do not have fins such that moisture carried into the freeze tunnel adjacent the entrance end thereof will condense on the coil 12*a*. The coils 62*c*, and 62*d*, and 62*e* preferably provided with tubes having fins since excessive moisture from air which might enter the freeze tunnel is collected on coils 62*a* having plain tube to facilitate defrosting.

Referring to FIG. 8, terminals T1 and T2 are connected to a source 110 volt electricity.

Terminal T1 is connected through line L1 and L1*a* to the pole of a rotary switch RS. A contact of rotary switch RS is connected through line L2*a* to one side of the coil of relay R1. The other side of the coil of relay R1 is connected to line L2. Thus, when the pole of rotary switch RS is positioned against the contact to which line L2*a* is connected, a circuit is completed through the coil of relay R1 thereby closing the normally open switches R1*a*–R1*e*.

A second contact of rotary switch RS is connected through line L1*b* to one side of the windings of motors 180*a* and 108*a'* and also to one side of the coil of solenoid actuated valve 102. The opposite sides of the windings of motors 108*a* and 108*a'* as well as the opposite side of the coil of solenoid actuated valve 102 are connected through the line L2*c* to a line L2*b* which is connected line switch R1*a* to lone L2 and terminal T2.

Thus, rotary switch RS is employed to selectively energize the coil of relay R1 or to energize the windings of motors 108*a* and 108*a'* and the coil of solenoid actuated valve 102.

Line L1 is connected through line L1*c* to switch R1*e* of relay R1 which is connected to the line L1d.

Line L1*d* is connected through L1*e* to one side of the coil of relay R2. The opposite side of the coil relay R2 is connected through lines L1*f* in series with thermal overload circuit breakers T02, T03, T04, and T05 and through signal light B1 and line L1*g* to normally closed contacts of relay R2. The pole of the normally closed contacts is connected through line L2*d* to line L2*b*.

Thus, when the coil of relay R2 is not energized a circuit is completed through the normally closed contact and signal light B1 is illuminated indicating that motors 58*a*–58*e* are not energized.

Line L1*f* is connected through normally closed switch S1 and line L1*h* to normally open switch S2 which is connected through line L2*e* to line L2*d*.

When switch S2 is momentarily closed, a circuit is completed through the coil of relay R2 breaking the circuit through normally closed contacts turning off bulb B1 and completing a holding circuit through line L1*j* and normally open contacts of relay R2 maintaining the coil of relay R2 in an energized condition. The holding circuit can be broken by momentarily opening switch S1.

Switch S1 is preferably spring biased to a closed position and switch S2 is preferably spring biased to an open position.

Bulb B2 connected in parallel with the coil of relay R2 is illuminated when the coil of relay R2 is energized to indicate that motors 58*a*–58*e* are energized.

Line L*d* is connected through line L1k to a switch in timing relay TR, through line L1*l* to temperature coontroller TC1 and temperature controller TC2 and to the primary windings of power supply PS. Line L1d is connected through line L1*m*, thermal overload device T01, and normally closed contacts of relay R4 to the coil of relay R3, the other side of which is connected to line L1*j*.

Line L1*d* is connected through line L1*n* to a normally closed contact of relay R4 which is connected through line L1*n'* to one side of the coil of solenoid actuated valve 116. The normally open switch of relay R4 is connected through line L1*n''* to one side of the coil of solenoid actuated valve 118. The opposite sides of coils of solenoid actuated valves 116 and 118 are connected through line L2*g* to line L2*b*.

Thus, when the coil of relay R4 is not energized the coil of solenoid actuated valve 116 is energized. When the coil of relay R4 is energized the circuit to the coil of solenoid actuated valve 116 is broken and a circuit is completed to the coil of solenoid actuated valve 118.

Line L2*b* is connected through line L2*h* to one side of the coil of relay R4 and the other side of the coil is connected through line L2*j* to a switch in time delay relay TR. Line L2*b* is also connected through line L2*k* to the primary winding of 12 volt direct current power supply PS.

The secondary winding of power supply PS is connected through lines PS1 to the timing mechanism of time delay relay TR which is connected through line PS2 to defrost controller 128 and through line PS3 to the opposite side of the secondary winding.

Defrost controller 128 is connected through lines PS4 and PS5 in parallel with timing mechanism of time delay relay TR.

Defrost controller 128 is described in our co-pending application Ser. No. 250,616, now U.S. Pat. No. 3,802,212, the description of which is incorporated herein by reference in its entirety.

Defrost controller 128 comprises a resistance bridge network arranged for energizing or de-energizing time delay relay TR which controls the apparatus for triggering and terminating a defrost cycle.

The resistance bridge network of defrost controller 128 includes a first thermistor 136 mounted in vapor exhaust line 120 through which nitrogen vapor is exhausted to atmosphere. Thermistor 136 is a temperature - sensitive resistance, the resistance of which varies with the temperature.

A second thermistor 138 is disposed inside pre-cooling zone 12 and is positioned such that air drawn across coil 62*a* blows across thermistor 138 when moving downwardly through plenum 85.

Thermistor 136 is connected through lines 136*a* and 136*b* to defrost controller 128 and thermistor 138 is connected through lines 138*a* and 138*b* to controller 128.

Thermistors 136 and 138 are connected in a resistance bridge network such that when the resistance of thermistor 136 increases more than the resistance of thermistor 138, because ice is formed on coils of heat exchanger 62*a*, the resistance bridge will become unbalanced. Current then energizes the coil of time delay relay TR connected across the bridge network, causing the flow of liquid nitrogen to be stopped causing motor 58*a* to be de-energized, and causing heater elements H1–H12 to be energized for melting ice from the surface of tubes of heat exchanger coil 62*a*.

It should be apparent that temperature sensor devices such as silicone diodes and thermal couples may be employed in lieu of thermistors 138 for sensing temperature and that changes in voltage or current may be employed to trigger defrost controller 128. It should further be apparent to persons skilled in the art that defrost controller 128 may include other and further devices for detecting an unbalanced condition in the bridge network.

When switches of time delay relay TR are closed, the coil of relay R1 is energized thereby closing valve 116 and opening valve 118 as hereinbefore described.

Temperature sensors, such as thermocouples 140 and 142, are connected through lines 140*a* and 142*a* respectively to temperature controllers TC1 and TC2. Temperature controller TC1 is connected through lines 140*b* and 140*c* to motor 108*a* for increasing or decreasing the flow rate of nitrogen vapor through valve 108.

Temperature controller TC2 is connected through lines 142*b* and 142*c* to valve 108*a'* for increasing or decreasing the flow of nitrogen vapor through valve 108*a'*.

Temperature controllers TC1 and TC2 are three mode type with proportional, integrative, and derivative action giving a proportional signal and thereby controlling the exact amount of refrigerant delivered to zones 18 and 20.

Power lines P1, P2, and P3 are connected through switches R1*b*, R1*c*, and R1*d* to a source of 230 volt three phase electricity and through contacts of relay R2 to motors 58*b*, 58*c*, 58*d*, and 58*e*.

When the coil of relay R3 is energized the windings of motor 58*a* are energized.

When the coil of relay R4 is energized a circuit is completed to heater elements H1–H12.

OPERATION

The operation and function of the apparatus hereinbefore described should be readily apparent. However, a brief description of the sequence of operation is as follows:

Completion of a circuit from line L1*a* through switch RS to line L2*a* energizes the coil of relay R1 connecting power lines P1, P2, and P3 to a source of 230 volt three cycle electricity and connecting the source of 110 volt electricity to power supply PS and temperature controller TC1 and TC2.

As switches of relay R1 close signal indicators B1 and B5 will be illuminated.

Closing switch S2 causes the coil of relay R2 to be energized thereby motors 58*b*–58*e*, energizing the coil of relay R3 to energize motor 58*a*, turning off indicator B1 and turning on indicator B2.

Thermocouples 140 and 142 monitor temperature of air flowing across coils 62*e* and 62*d* respectively while temperature controllers TC1 and TC2 maintain flow through valves 108 and 108*a* at a rate necessary to maintain predetermined temperature levels adjacent the respective coils.

Nitrogen vapor from coil 62*b*–62*d* flows through valve 116 to coil 62*a*. Valve 118 is closed.

When frost on the surface of coil 62*a* causes a temperature differential as hereinbefore described defrost controller 128 energizes time delay relay TR completing a circuit from line L1*k*through line L2*j* to energize a coil of relay R4, turning on bulb B6, closing valve 116, opening valve 118 and energizing heater elements H1–H12 while breaking the circuit through the coil of relay R3. Thus, blower motor 58*a* is turned off, valve 116 is closed, valve 118 is opened and heater elements H1–H12 are energized.

When time delay relay TR resets at the expiration of a predetermined time interval the circuit through the coil of relay R4 will be broken closing valve 118, opening valve 116, energizing blower motor 58*a*, and de-energizing heater elements H1–H12.

Conveyor motor 42 is energized by closing switch 42*a* and the speed of the motor is controlled by adjustment of potentiometer 42*b*.

From the foregoing it should be readily apparent that other and further embodiments of our invention may be devised without departing from the basic concept thereof.

Having described our invention, we claim:

1. Freezer apparatus comprising: first and second heat exchanger means having inlets and outlets; means to deliver coolant to the inlet of the first exchanger means; a conduit connecting the outlet of the first exchanger means to the inlet of the second heat exchanger means; an exhaust line connected to the outlet of the first exchanger means; signal responsive valve means in said conduit and in said exhaust line; means to heat said second heat exchanger mean; sensor means positioned in heat exchange relation with coolant discharged from second heat exchanger; signal generator means operably connected to said sensor means and to said signal responsive valve means and to said heater means, said signal generator means being adapted to generate signals to actuate said valve means such that flow of coolant is diverted from the first heat exchanger to the exhaust line and the heater means is energized when temperature of coolant exhausted from said second heat exchanger is less than a predetermined temperature.

2. The combination called for in claim 1 wherein the first and second heat exchangers comprise coils.

3. The combination called for in claim 1 wherein the first heat exchanger comprises: circular tubes; and means to mount said tube forming a coil.

4. The combination called for in claim 3 with the addition of a centrifgual blower; means supporting said coil around the blower such that the blower moves air over surfaces of the coil.

5. The combination called for in claim 4 with the addition of: a circular plenum about said coil.

6. The combination called for in claim 1 wherein the first heat exchanger means comprises: first and second sets of coils; means to connect the coils of the first set in series; means to connect the coils of the second set in series; and means to connect the first set of coils in parallel with the second set of coils.

7. The combination called for in claim 6 wherein the means to deliver coolant to the inlet of the first heat exchanger means comprises: a temperature sensor adjacent one of the coils in each set of coils; valve means associated with each set of coils; and control means between the temperature sensor and the valve means to increase and decrease flow of coolant to each set of coils responsive to change in temperature adjacent each set of coils.

8. The combination called for in claim 1 wherein the source of coolant comprise a tank of liquid nitrogen.

9. The combination called for in claim 1 with the addition of: conveyor means; and means to move the conveyor means from the second heat exchanger toward the first heat exchanger.

10. Freezer apparatus comprising: a first set of cooling coils; means connecting coils of the first set in series; a second set of cooling coils; means connecting coils of the second set in series; a source of liquid nitrogen; a supply line between said source of liquid nitrogen and the first and second set of cooling coils; valve means in said supply line to control flow of fluid to said first and second sets of cooling coils; actuated means operably connected to said valve means; temperature sensor means positioned adjacent a coil of each set of coils; actuating means connected between the temperature sensor means and the actuated means arranged to control flow of fluid through each set of coils in response to temperature adjacent a coil of each set of coils; a heat exchanger having an inlet passage and an outlet passage; means to deliver fluid from said first and second sets of cooling coils in parallel to the inlet passage of said heat exchanger; and means to circulate air over surfaces of said cooling coils and said heat exchanger.

11. The combination called for in claim 10 with the addition of exhaust temperature sensor means adjacent said exhaust passage; air temperature sensor means adjacent said heat exchanger; heater means adjacent said heat exchanger; and means to energize said heater means when the temperature of air adjacent the heat exchanger exceeds the temperature of fluid exhausted from the heat exchanger by a predetermined temperature.

* * * * *